US005103506A

United States Patent [19]

Munford et al.

[11] Patent Number: 5,103,506

[45] Date of Patent: Apr. 14, 1992

[54] TOILET SEAT LIFTER

[76] Inventors: Mark R. Munford, 5 View Street, R.R. 1, Ajax, Ontario, Canada, L7S 4S7; Robert R. Cormier, R.R. #1, Hastings, Ont., Canada, K0L 1Y0

[21] Appl. No.: 586,200

[22] Filed: Sep. 21, 1990

[51] Int. Cl.[5] ..... A47K 13/10

[52] U.S. Cl. ..... 4/251

[58] Field of Search ..... 4/251, 241, 624, 250, 4/263, 357

[56] References Cited

U.S. PATENT DOCUMENTS

| | | | |
|---|---|---|---|
| 1,590,298 | 6/1926 | Landis | 4/251 |
| 1,877,083 | 9/1932 | Thrasher | 4/251 |
| 4,592,097 | 6/1986 | Zimmerman | 4/251 |

FOREIGN PATENT DOCUMENTS

| | | | |
|---|---|---|---|
| 0067372 | 8/1948 | Denmark | 4/251 |

*Primary Examiner*—Daniel M. Yasich
*Attorney, Agent, or Firm*—Mirek A. Waraksa

[57] ABSTRACT

A foot-actuated lifting mechanism for a toilet seat requires no modification of the toilet or surrounding structure. The lifting mechanism has a hollow vertical housing, an upper transverse bracket for attachment to a toilet seat bolt, and a lower transverse bracket for attachment to a toilet base bolt. A spacing adjustment mechanism permits the vertical spacing between the brackets to be adjusted to accommodate different toilet dimensions. A pivoting arm locates under the toilet seat, and a floating connection permits pivoting of the toilet seat lid with the arm and simultaneous translation relative to the arm to accommodate differences in rotational axes. A pedal is free-standing on the floor surrounding the toilet and pivots on a fulcrum. A linkage mechanism couples the pedal to the arm so that depression of the pedal raises the toilet seat. The linkage can be extended or retracted to ensure that the pedal rests on the floor regardless of any spacing adjustment. Torsion and compression springs associated with the linkage mechanism prevent slamming of the toilet seat against either the base of the toilet or the associated reservoir.

28 Claims, 4 Drawing Sheets

TOILET SEAT LIFTER

FIELD OF THE INVENTION

The invention relates to foot-actuated mechanisms for lifting toilet seats and lids.

BACKGROUND OF THE INVENTION

To the inventors' knowledge, there exists no commercially-available foot-actuated toilet seat lifting mechanism which avoids sanitary problems associated with raising or lowering of a toilet seat. To be practical, such a device would have to be unobtrusive, easy to install, and should require no significant modification of the toilet itself or any adjoining floor or wall structure. Also, it should not result in slamming of the toilet seat against the reservoir or bowl associated with the toilet either upon operation of an associated foot pedal or accidental release of the foot pedal. It is accordingly an object of the invention in preferred form to provide such a lifting mechanism.

SUMMARY OF THE INVENTION

In one aspect, the invention provides a foot-actuated lifting mechanism for a toilet seat comprising an elongate support structure having upper and lower end portions. An upper bracket extends transversely from the upper end portion of the support structure, and a lower bracket extends transversely from the lower end portion of the support structure. Spacing adjustment means are provided to permit selective adjustment of the vertical spacing between the upper and lower brackets to accommodate variations in the dimensions of the toilet, particularly the height of the associated toilet bowl. Means are provided for releasably joining the upper bracket to a seat bolt associated with the toilet and the lower bracket, to a base bolt associated with the toilet. For purposes of the invention, the term "seat bolt" should be understood as a screw or bolt commonly used to anchor the toilet seat or an associated mounting assembling to the base of the toilet and the term "base bolt" should be understood as a bolt which normally extends through the floor on which the toilet rests and fastens the base of the toilet to the floor. An arm is located in an upper end portion of the support structure. Means are provided for forming a floating connection between the arm and the toilet seat, the floating connection permitting pivoting of the toilet seat with the arm and also translation of the toilet seat relative to the arm during such pivoting. A pedal is located at a lower end portion of the support structure. Linkage means connect the foot pedal to the arm such that pivoting of the foot pedal causes pivoting of the arm thereby permitting foot-actuating raising of the toilet seat.

The pedal in the preferred form of the invention is preferably "free-standing", that is, it rest directly on the floor but does not require attachment to the floor itself for proper operation. This avoids the need for cumbersome attachment to the floor and, very significantly, causes forces applied to the foot pedal, as when a user slips and accidentally applies his full body weight to the pedal, to be reacted largely into the floor rather than through the housing. Means are preferably provided to permit an effective extension or contraction of the linkage means such that the foot pedal can rest on the floor despite variations in spacing between the upper and lower connecting brackets. The preferred form of pedal comprises a first end portion releasably connected to the linkage means, a second opposing end portion, and a fulcrum intermediate the first and second foot pedal end portions which can be contacted on a floor adjacent the toilet so that depression of the second foot pedal end portion raises the toilet seat.

Biasing means are preferably provided to prevent slamming of the toilet seat against either the water reservoir associated with the toilet or against the toilet bowl or base structure associated with the toilet. The biasing means preferably comprise a torsion spring which applies a lowering torque at the toilet seat and a compression spring which applies a raising torque. A biasing adjustment mechanism is preferably provided to permit adjustment of the torque effectively applied by at least one of the springs. In preferred form, the biasing means can be arranged effectively to apply a raising torque when the toilet seat is inclined at less than some predetermined angle relative to horizontal and a lowering torque when the toilet seat is inclined at less than the predetermined angle. The predetermined angle will normally occur intermediate fully raised and lower positions of the toilet seat.

Other aspects and advantages associated with the present invention will be described below in connection with the preferred embodiment and will be more specifically defined in the appended claims.

DESCRIPTION OF THE DRAWINGS

The invention will be better understood with reference to drawings illustrating a preferred embodiment in which.

DESCRIPTION OF THE PREFERRED EMBODIMENT

Figure 1:
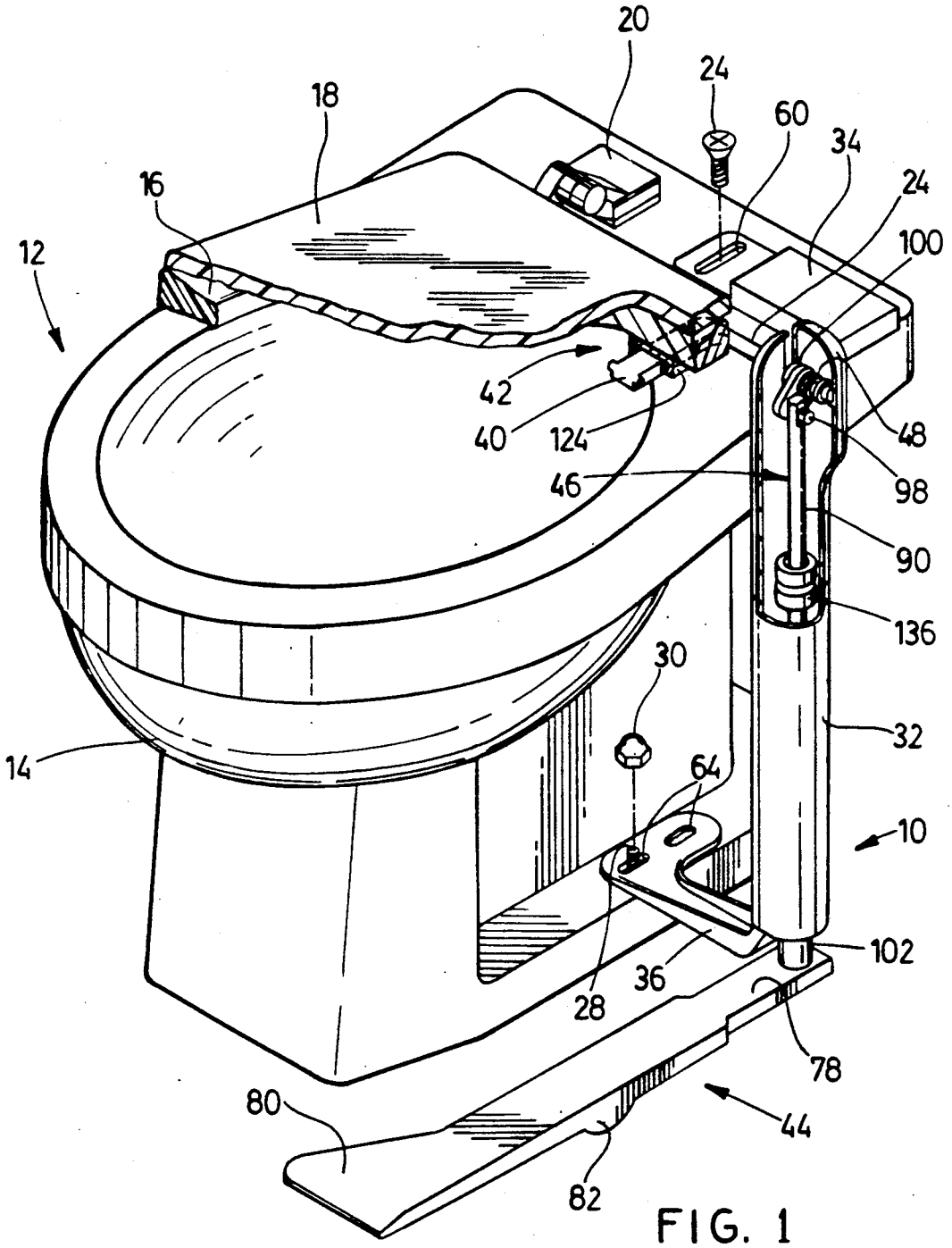
FIG. 1 is a fragmented perspective view of a toilet on which a toilet seat lifting mechanism embodying the invention has been installed.

FIG. 1 shows a foot-actuated lifting mechanism 10 releasably installed at the right side of toilet 12. The toilet 12 may be seen to comprise a toilet bowl 14, a seat 16 and a seat lid 18. A water reservoir which normally extends upwardly from rear of toilet bowl 14 has not be illustrated. The seat 16 and lid 18 are pivotally mounted at an upper rear surface of toilet bowl 14 with a pair of standard pivot mounts. Only one pivot mount 20 has been illustrated, the other having been removed for purposes of illustrating how the lifting mechanism 10 attaches to the top of the toilet bowl by locating about a seat bolt 24. The seat bolt 24 would normally fasten the relevant pivot mount to the toilet bowl 14 and would itself be concealed by the pivot mount. The base 26 of the toilet 12 is fastened on opposing sides thereof to the supporting floor (not illustrated) by conventional base bolts, such as the bolt 28 at the right side. The bolt 28 is associated with a crown nut 30 but may often have a more conventional nut attached thereto to secure to the toilet base 26 to the floor.

Figure 2:
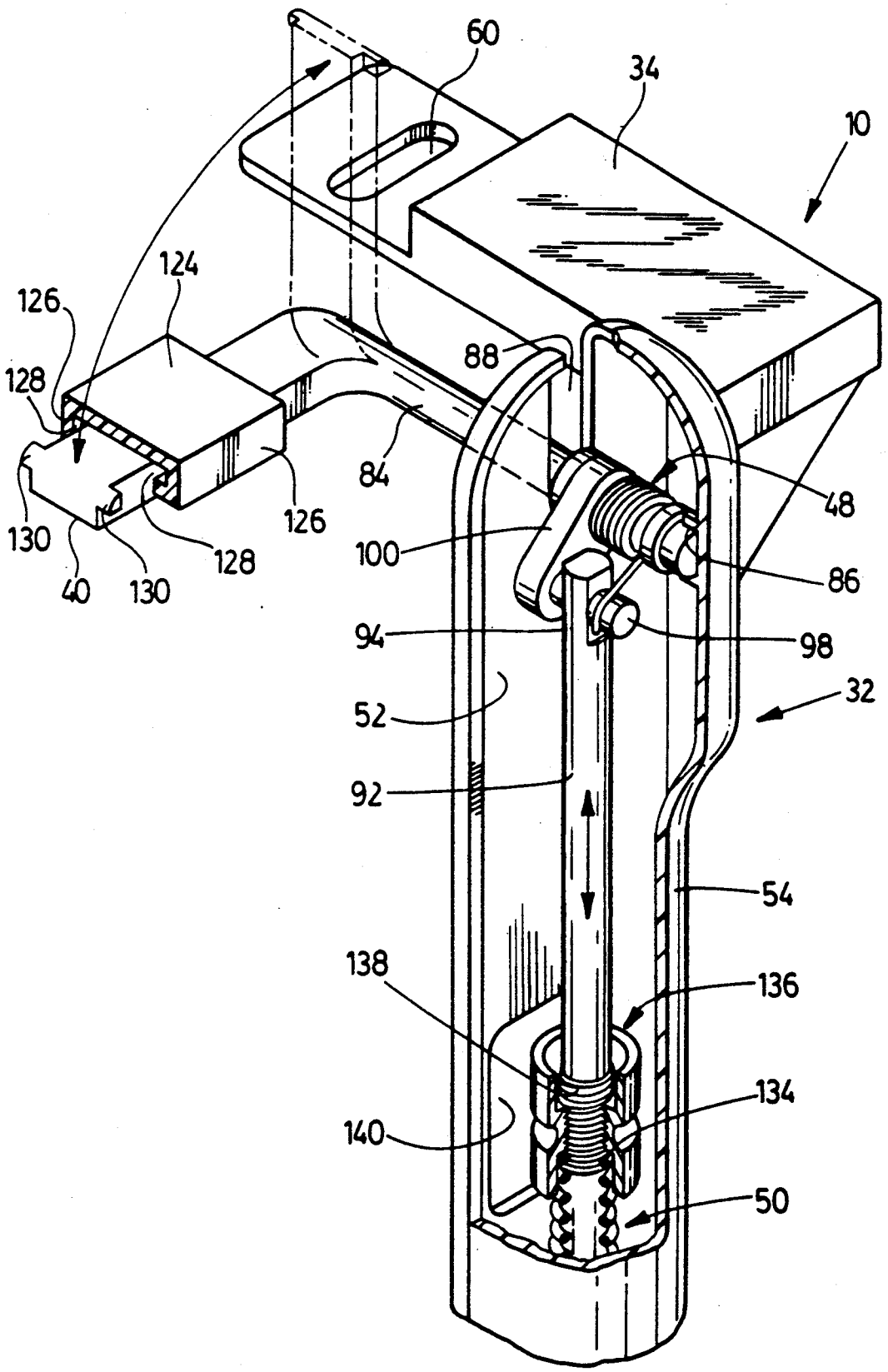
FIG. 2 is a fragmented perspective view of an upper end of the lifting mechanism detailing a pivoting arm which engages the toilet seat and a portion of linkage which immediately raises the toilet seat in response to foot pedal operation.
Figures 3, 3A:
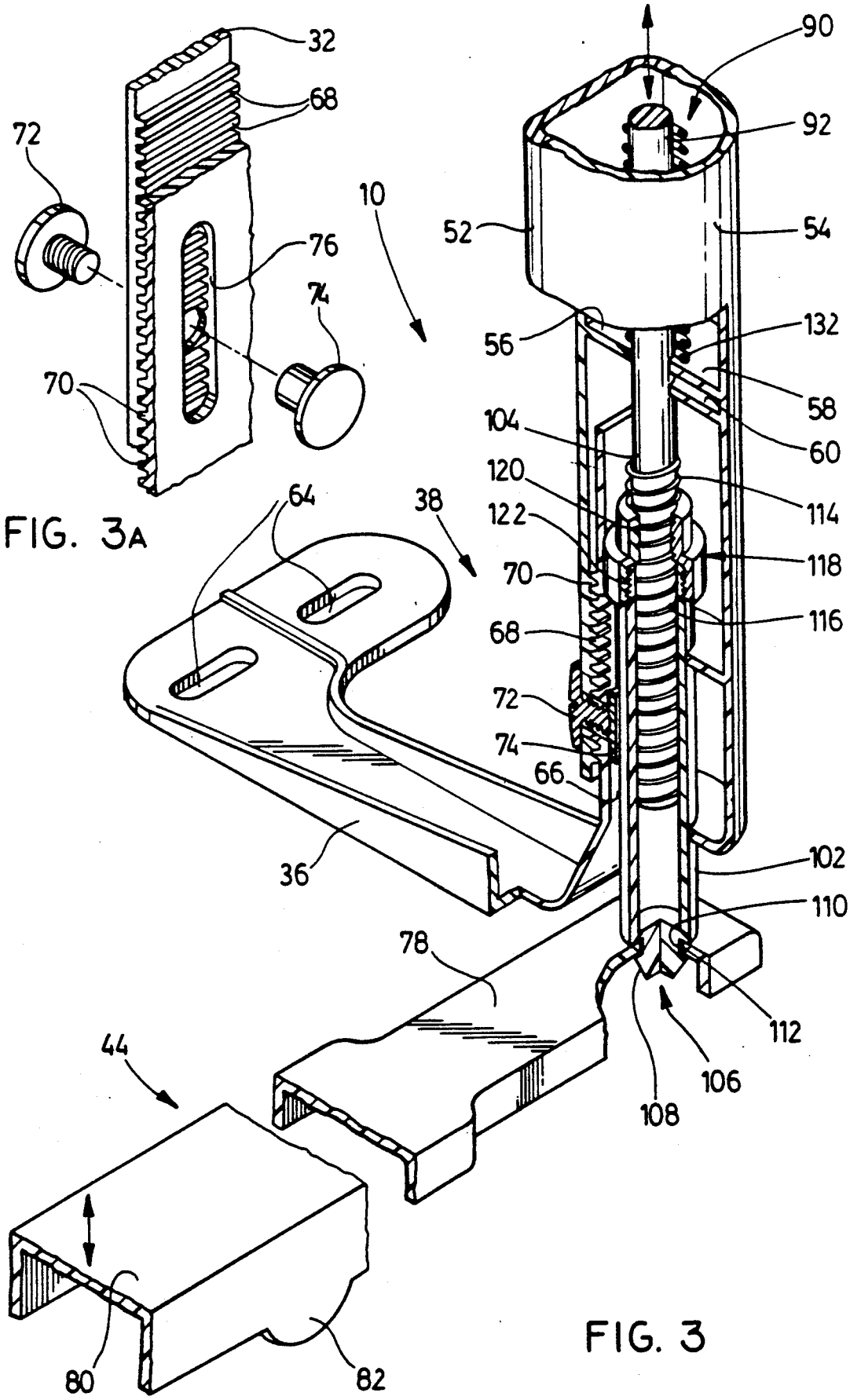
FIG. 3 is a fragmented perspective view of a lower end of the lifting mechanism and of an associated pedal.
FIG. 3A is an enlarged partially exploded and extensively fragmented view of certain height adjustment structure in FIG. 3.

The principal components of the lifting mechanism 10 will be identified before describing construction in detail. The lifting mechanism 10 includes an elongate vertical support structure in the form of a hollow housing 32. An upper mounting bracket 34 extends transversely from an upper end portion of the housing 32, and a lower plastic mounting bracket 36 extends transversely from a lower end portion of the housing 32. A spacing adjustment mechanism 38 is indicated in FIG. 3. This permits selective adjustment of the vertical spacing or height between the upper and lower brackets 34, 36 in response to the height of any particular toilet bowl. An arm 40 is supported at the upper end portion of the housing 32 for pivoting movement. The arm 40 is connected to the toilet seat 16 and is the member of the lifting mechanism 10 which directly applies raising and lowering torques to the toilet seat 16. A floating connection 42 which attaches the arm 40 to the toilet seat 16 is most apparent in FIGS. 2 and 4. A free-standing foot pedal 44 is located at the lower end portion of the housing 32, and a linkage mechanism 46 located largely in the interior of the housing 32 couples the foot pedal 44 to the pivoting arm 40 such that depression of the foot pedal 44 causes pivoting of the arm 40 and ultimately raising of the toilet seat 16 and lid 18. Biasing means in the form a torsion spring 48 and a compression spring 50 prevent slamming of the toilet seat 16 and lid 18 against either the bowl 14 when lowered or against the reservoir (not illustrated) when raised. The compression spring 50 also serves to apply an adjustable lifting torque to the seat 16 when fully-lowered that counterbalances the weight of the seat, and the torsion spring 48 applies a lowering torque, when the seat 16 is fully raised by foot pedal operation, that permits restoration of the seat 16 to its lowered position without hand contact. With the exception of the biasing springs 48, 50, all components of the lifting mechanism 10 are injection molded of plastic.

The housing 32 has essentially a two-part construction. This includes a first, relatively shallow component 52 and a second, relatively deep component 54. The two components 52, 54 snap fit together in a conventional manner as by insertion of a fastening element 56 formed with the first component 52 between a pair of fastening elements 58, 60 formed with the second component 54. A hollow housing is used as the support structure largely to conceal most components of the linkage mechanism 46 thereby enhancing the appearance of the lifting mechanism 10 and reducing the amount of cleaning which might otherwise be required.

The upper and lower brackets 34, 36 are adapted for releasable attachment to the seat and base bolts associated with the toilet 12. The upper bracket 34 is associated with a single opening 62 which can be fitted about the seat bolt 24. The lower bracket 36 is associated with a pair of spaced-apart openings 64, one of which can be located about the base bolt 28 as illustrated in FIG. 1. Two elongate openings 64 have been provided to accommodate variations in the positioning of base bolts associated with different toilets. The upper bracket 34 is rigidly fixed to the upper end portion of the housing 32. However, the lower bracket 36 is separate and movable relative to the housing 32. For purposes of spacing adjustment, an extension 66 is integrally formed with the lower bracket 36 and extends upwardly through an open lower end of the housing 32 into the housing interior. A first set of vertically spaced-apart teeth 68 are formed on the extension 66. A second set of vertically spaced-apart teeth 70 are formed on an interior wall of the housing 32. These can be releasably meshed and maintained in meshed relationship (as in FIGS. 3 and 3A) by tightening a bolt 72 accessible at the exterior of the housing 32 and a nut 74 located in the interior of the housing 32. The nut 74 has a head which bears against the extension 66 and an internally threaded sleeve which seats in a clearance hole provided in the first housing portion where the bolt 72 is received. The bolt 72 and nut 74 remain stationary, but a vertical slot 76 associated with the extension 66 permits vertical displacement of the lower bracket 36 axially relative to the housing 32 when the bolt 72 and nut 74 are loosened. Accordingly, the separation of the brackets 34, 36 can be adjusted to accommodate the particular height of any toilet bowl 14 to which the lifting mechanism 10 is to be secured.

The foot pedal 44 is free-standing on the floor (not illustrated) adjacent the toilet. The foot pedal 44 has first and second opposing end portions 78, 80, the second end portion 80 being appropriately shaped for depression by foot. A fulcrum 82 is formed on a lower side of the foot pedal 44 intermediate the opposing foot pedal end portions 78, 80. When the fulcrum 82 is rested on the floor, depressing the second pedal end portion 80 by foot causing the first pedal end portion 78 to rise vertically, this movement ultimately being transformed by the linkage mechanism 46 into a rotation of the arm 40 and lifting of the toilet seat 16 and lid 18.

The linkage mechanism 46 includes a horizontal shaft 84 rotatable about its longitudinal axis. One end of the shaft 84 mounts in a circular seating element 86 defined in the second housing component 54, the seating element 86 permitting rotation of the shaft 84 about its longitudinal axis. A vertical slot 88 in the upper end of housing 32 permits introduction, rotatable mounting, and removal (if necessary) of the horizontal shaft 84. The housing edge defining the bottom of slot also serves to support the horizontal shaft 84. The arm 40 extends transversely from the horizontal shaft 84 such that it pivots with shaft rotation.

The linkage mechanism 46 includes an axial drive member 90 vertically oriented in the housing 32. It is supported by structure molded with the two housing components (illustrated but no specifically indicated) for axial (vertical) movement within the housing 32. The axial drive member 90 comprises a solid vertical shaft 92 of generally circular cross-section. An upper end portion 94 of the vertical shaft 92 is formed with an opening which receives a pin 98 extending from a crank 100 molded with the rotatable horizontal shaft 84. This arrangement transforms axial displacement of the axial drive member 90 into rotation of the horizontal shaft 84.

The axial drive member 90 includes an extension sleeve 102 attached to a lower end portion 104 of the solid vertical shaft 92. The lower end of the extension sleeve 102 is formed with an attachment head 106 having a beveled outer surface 108 and associated with a circumferential undercut 110. The attachment head 106 simply snap fits in a releasable fashion into an aperture 112 associated with the first pedal end portion 78. Depression of the second pedal end portion 80 consequently raises the axial drive member 90 and in turn rotates the horizontal shaft 84. This action is in turn transformed into a pivoting of the arm 40 and results in a lifting torque being applied to the toilet seat 16 and lid 18.

The extension sleeve 102 can be rotated to effectively extend or contract the axial drive member 90. The extension sleeve 102 has a central axial passage with an upper open end which receives a lower end portion 104 of the solid vertical shaft 92. The lower shaft end portion 104 may be seen to comprise an external screw thread 114. An upper end portion of the extension sleeve 102 also has an external screw thread 116. A plastic nut 118 (formed using rotary molds) having upper and lower internal screw threads 120, 122 joins the extension sleeve 102 and the solid vertical shaft 92. The upper screw thread 120 of the nut 118 receives the external screw thread 114 of the shaft 92 while the lower screw thread 122 of the nut 118 receives the external screw thread 116 of the extension sleeve 102. The nut 118 is securely tightened to the extension sleeve 102 and the sleeve 102 together with the nut 118 can be rotated by hand to effectively extend and contract the axial drive member 90. Accordingly, when the vertical separation of the upper and lower brackets 34, 36 is adjusted to accommodate the height of a particular toilet bowl 14, the extension sleeve 102 may be rotated either to extend or retract the axial drive member 90 so as to permit the fulcrum 82 of the foot pedal 44 to rest properly on the adjacent floor and permit proper pivoting action on the associated fulcrum 82.

With the type of lifting mechanism 10 described herein, it is fully expected that the pivot axis of the arm 40 (namely, the rotational axis of the horizontal shaft 84) will not be coincident with the pivot axis of the toilet seat 16 and lid 18. The lifting torque applied by the arm 40 might consequently be reacted into the pivot mounts or analogous structure associated with the toilet seat 16 and lid 18, frustrating any lifting effect. To accommodate this problem without modification of the toilet itself, the floating connection 42 is provided. This connection 42 comprises a channeled member 124 which can be fastened with an adhesive or other appropriate means to the underside of the toilet seat 16. The channeled member 124 has a pair of opposing sidewalls 126 which are undercut to define two longitudinal grooves 128. The end of the arm 40 distant from the rotatable horizontal shaft 84 is formed with a pair of opposing, outwardly-directed projections 130 at opposite sides of the arm 40. These projections 130 travel in the undercut sidewalls 126 of the channeled member 124. Accordingly, the arm 40 can be pivoted between a first position (solid in FIG. 2) in which the attached toilet seat 16 is fully lowered against the toilet bowl 14 and a second position (phantom in FIG. 2) in which the toilet seat 16 is fully raised and rested against the associated reservoir. During such pivoting, the floating connection 42 permits translation of the toilet seat 16 along the axis of the arm 40. This arrangement ensures that despite the fact that the various pivot axes may not be coincident, the toilet seat 16 and lid 18 can respond to torques applied by the arm 40.

The torsion and compression springs 48, 50 in combination apply net raising and lowering torques to the toilet seat 16 depending on the angle the seat forms relative to horizontal. The torsion spring 48 is mounted on the rotatable horizontal shaft 84, one end thereof (not illustrated) being fixed to the housing 32, the other end engaging the pin 98 associated with the crank 100. The torsion spring 48 tends to produce a lowering torque at the toilet seat 16.

The compression spring 50 is axially aligned with the solid vertical shaft 92 of the axial drive member 90 and receives the shaft centrally therethrough. A lower end 132 of the compression spring 50 rests against the upper surface of the fastening element 58 (see FIG. 3). The upper end 134 of the compression spring 50 acts against a stop nut 136 attached to the solid vertical shaft 92 (see FIG. 4). The stop nut 136 is injection molded of plastic using a rotary mold to define an internal screw thread, and is threaded onto an upper external screw thread 138 associated with the solid vertical shaft 92. The stop nut 136 can be rotated through an opening 140 provided in the first housing component 52 (see FIG. 2) to contract or extend the compression spring 50 thereby varying the lifting force applied by the compression spring 50 to the axial drive member 90 and consequently the raising torque ultimately applied to the toilet seat 16.

Figure 4:
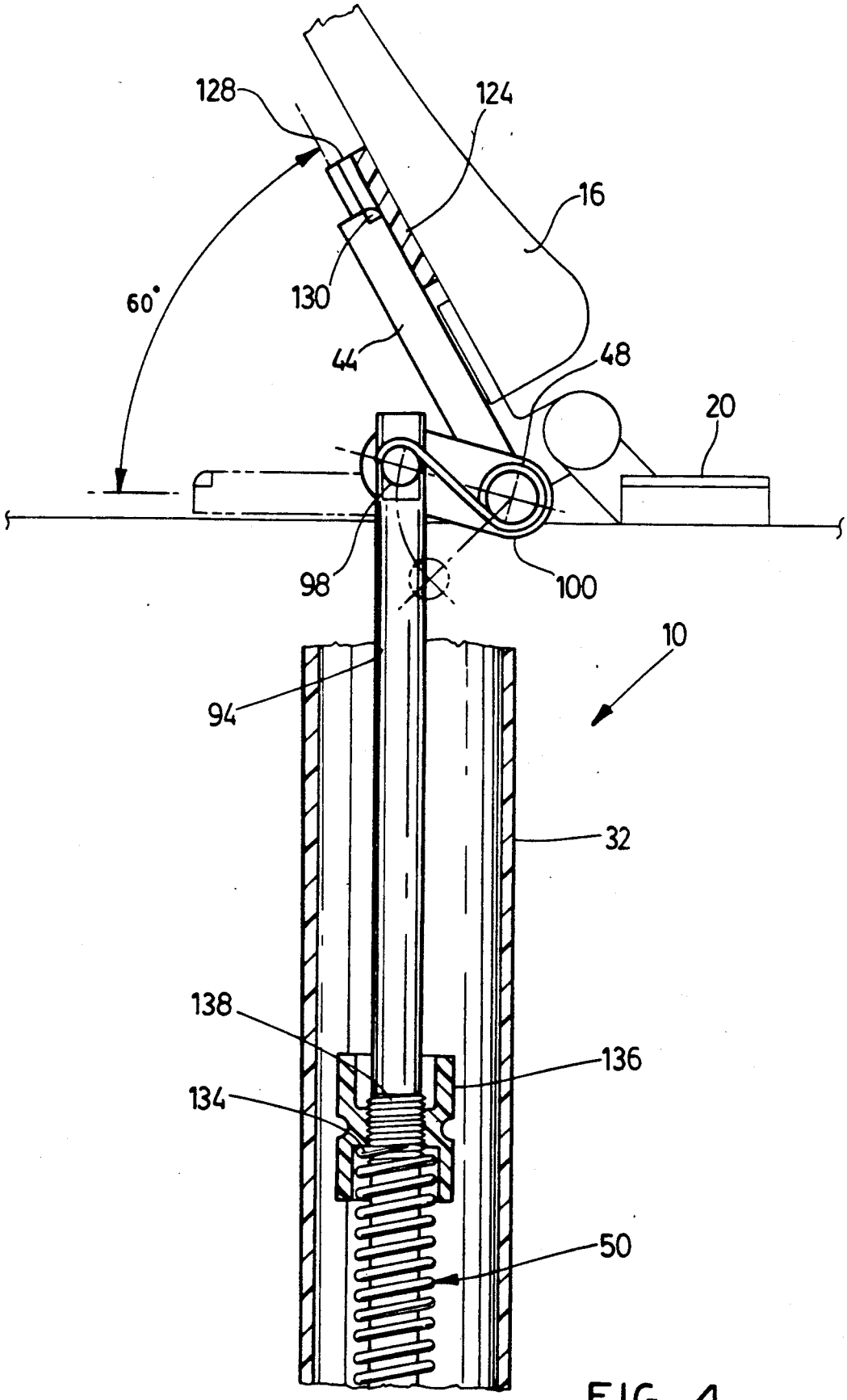
FIG. 4 is a fragmented view in partial vertical cross-section illustrating aspects of the operation of the lifting mechanism.

The force generated by the compression spring 50 might typically be adjusted so that there is no net torque applied by the pair of biasing springs 48, 50 when the toilet seat 16 and lid 18 are in the position shown in FIG. 4, that is, inclined at about 60 degrees relative to horizontal. Below 60 degrees, the operation of the compression spring 50 dominates and there is a net raising torque applied to the toilet seat 16 and lid 18. The raising torque increases as the seat is lowered towards the toilet bowl 14. This has two effects: first, it reduces slamming of the toilet seat 16 against the toilet bowl 14 if the foot pedal 44 is suddenly released; second, it assists in raising of the toilet seat 16 under foot pedal 44 operation, counterbalancing the effect of gravity on the toilet seat 16. Above 60 degrees, the operation of the torsion spring 48 dominates and there is a net lowering torque applied. This lowering torque increases as the angle of inclination of the toilet seat 16 relative to horizontal increases above 60 degrees. This reduces the tendency for the toilet seat 16 and lid 18 to slam against the reservoir, and also serves the important function of causing the toilet seat 16 to restore to a fully lowered position without hand contact when foot pressure against the pedal 44 is gradually released.

Although other biasing arrangement may be used in connection with the broad aspect of the invention, this arrangement of counterbalancing springs is strongly preferred. It should be noted that biasing adjustment by means of the stop nut 136 also permits the lifting mechanism 10 to accommodate the weight of different toilet seats. A heavier toilet seat 16 will require greater raising torques to facilitate lifting and to prevent slamming against the toilet bowl 14, and this can be conveniently accommodated by contracting the compression spring 50.

Installation and operation of the lifting mechanism 10 will be briefly described, although such matters should be largely apparent from the foregoing description of its construction. The seat bolt 24 associated with one side of the toilet will be released, as will the crown nut 30 associated with the base bolt 28 at that side. The spacing adjustment mechanism 38 can then be released. The arm 40 is located beneath the toilet seat 16, and the upper and lower brackets 34, 36 installed on the seat and base nuts. The spacing may be adjusted during attachment of the brackets 34, 36 and fixed once the brackets 34, 36 are properly in place. The upper surface of the channeled member 124 may then be adhered to the bottom of the seat. For such purposes, the upper surface may be coated with a pressure-sensitive adhesive and covered with a peel-away protective sheet (not illustrated). The foot pedal 44 can then be attached, raising the toilet or rotating the extension sleeve 102 appropriately to provide adequate clearance between the attachment head 106 and the foot pedal 44, if necessary. (The foot pedal 44 may, however, be attached to the linkage mechanism 46 prior to attachment of the lifting mechanism 10 to the toilet). The extension sleeve 102 may then be rotated to ensure that the foot pedal 44 rests properly on the floor and to ensure that proper pivoting action of the foot pedal 44 about its fulcrum 82 occurs.

To raise the toilet seat 16, one merely depresses the second end portion 80 of the foot pedal 44. This raises both the toilet seat 16 and the associated lid 18 from the toilet bowl. The toilet seat 16 is maintained in its raised position, if this is desired, by continued application of foot pressure to the pedal 44. If the seat 16 is to be used, it can be lowered without hand contact initially under the influence of the torsion spring 48 and then under gravity, descent being controlled by gradually releasing foot pressure applied to the pedal 44. The lid 18 will then remain against the reservoir, and the toilet seat 16 will be available for use.

It is not necessary for the housing 32 to be perfectly vertical for proper operation. Accordingly, the lifting mechanism 10 illustrated can be installed in operative relationship on most conventional toilets which involve reasonably similar placement of seat and base bolts. To accommodate variations in bolt spacing, however, the upper and lower brackets 34, 36 may be formed with multiplicity of attachment openings positioned relative to one another to accommodate differences in bolt placement and formed as elongate slots to permit a measure of play. It is contemplated that the lifting mechanism 10 as sold would include a separate apertured shim (not illustrated) which would mount on the seat bolt or bolts on the side of the toilet opposite to where the lifting mechanism 10 is installed below the pivot mount 20. The shim would have an appropriate thickness so as to maintain the seat 16 and lid 18 level. An alternative arrangement is to extend the upper bracket 34 sufficiently that it can be fastened to the seat bolts beneath both pivot mounts.

It will be appreciated that the lifting mechanism 10 is relatively unobtrusive and can be easily installed. The mechanism 10 requires no significant modification of a toilet itself or any adjoining floor or wall structure. The spacing adjustment means and manner of attachment lend themselves to universal installation. The free-standing pedal rested against the floor is particularly advantageous as the support structure need not be constructed to withstand excessive forces such as the full weight of a person accidentally bearing down on the pedal. Such forces are conveniently reacted into the floor. Also, the foot pedal can be conveniently removed and reinstalled to permit cleaning of the floor adjacent to a toilet. The biasing springs reduce inadvertent slamming of the toilet seat against either the reservoir or bowl associated with a toilet. The biasing is also adjustable to accommodate toilet seats or lids of different weight, once again facilitating universal application. Lastly, the application of a net lowering torque to the toilet seat 16 when fully raised avoids any need for hand contact to restore the toilet seat to a fully lowered position for use.

It will be appreciated that a particular embodiment of the invention has been described to illustrate operating principles and features associated with the invention. Modifications may be made therein without departing from the spirit of the invention and without necessarily departing from the scope of the appended claims.

We claim:

1. A foot-actuated lifting mechanism for a toilet seat, comprising:

an elongate support structure having an upper end portion and a lower end portion;

an upper bracket attached to and extending transversely from the upper end portion of the support structure and adapted to cooperate with a seat bolt of the toilet to secure the upper end portion of the support structure to the toilet;

a lower bracket attached to and extending transversely from the lower end portion of the support structure and adapted to be cooperate with a base bolt of the toilet to secure the upper end portion of the support structure to the toilet;

spacing adjustment means attached to the elongate support structure for selectively varying the vertical spacing between the upper and lower brackets at least prior to securement of the support structure to the toilet;

an arm adjacent to the upper end portion of the support structure and disposed with respect to the brackets such that the arm can locate beneath the toilet seat as the support structure is secured to the toilet by the upper and lower brackets;

means for forming a floating connection between the toilet seat and the arm, the floating connection permitting upward and downward pivoting of the toilet seat with the arm and translation of the toilet seat relative the arm during such pivoting of the toilet seat with the arm;

a foot pedal;

linkage means attached to and supported by the support structure for connecting the foot pedal to the arm such that pivoting of the foot pedal pivots the arm upwardly thereby to raise the toilet seat.

2. A lifting mechanism as claimed in claim 1 in which the linkage means comprise:

a shaft rotatable about its longitudinal axis, the arm extending transversely from the shaft;

an axial drive member;

means attaching the axial drive member to the support structure such that axial displacement of the axial drive member causes rotation of the rotatable shaft; and, means for connecting the axial drive member to the foot pedal such that depressing the foot pedal causes axial displacement of axial drive member.

3. A lifting mechanism as claimed in claim 2 in which the foot pedal is free-standing, the foot pedal having a first end portion connected to the axial drive member, a second opposing end portion, and a fulcrum intermediate the first and second foot pedal end portions which can be contacted on a floor adjacent the toilet such that depression of the second foot pedal end portion raises the axial drive member vertically.

4. A lifting mechanism as claimed in claim 3 comprising means for permitting vertical extension and contraction of the axial drive member such that the fulcrum of the foot pedal can be rested on the floor with changes in the vertical separation of the upper and lower brackets.

5. A lifting mechanism as claimed in claim 2 in which the linkage means comprises biasing means for applying a lowering torque to the toilet seat when the toilet seat forms an angle relative to horizontal which is greater than a predetermined angle and for applying a lifting torque to the toilet seat when the toilet seat forms an angle relative to horizontal which is less than the predetermined angle.

6. A lifting mechanism as claimed in claim 5 in which the biasing means comprise:

a torsion spring connected to the rotatable shaft, the torsion spring producing a torque at the toilet seat which tends to lower the toilet seat;

a compression spring connected to the axial drive member, the compression spring producing a torque at the toilet seat which tends to raise the toilet seat.

7. A lifting mechanism as claimed in claim 6 in which:

the compression spring is coaxially aligned with the axial drive member;

the support structure defines a lower stop for engaging a lower end portion of the compression spring;

the axial drive member is associated with an upper stop for engaging an upper end portion of the compression spring;

the upper stop is threaded onto the axial drive member such that the vertical spacing between the upper and lower stops can be adjusted by rotating the upper stop about the axial drive member thereby adjusting the lifting torque produced by the compression spring at the toilet seat.

8. A lifting mechanism as claimed in claim 2 in which the foot pedal is free-standing, the foot pedal having a first end portion connected to the axial drive member, a second opposing end portion and a fulcum intermediate the first and second foot pedal end portions which can be contacted on a floor adjacent the toilet such that depression of the second foot pedal end portion raises the axial drive member vertically.

9. A lifting mechanism as claimed in claim 8 in which:

the spacing adjustment means permit the vertical position of the lower bracket relative to the support structure to be adjusted;

the linkage means comprise means for permitting vertical extension of a lower end portion of the linkage means such that the fulcrum of the foot pedal can be rested on the floor with changes in the vertical position of the lower bracket.

10. A lifting mechanism as claimed in claim 9 in which:

the linkage means comprise a vertically-oriented rod;

the extension-permitting means comprise a member in threaded engagement with the rod and connected to the foot pedal, the member being rotatable to increase and decrease the vertical separation between the foot pedal and the rod.

11. A lifting mechanism as claimed in claim 1 comprising biasing seat forms an angle relative to horizontal which is greater than a predetermined angle and for applying a lifting torque to the toilet seat forms an angle relative to horizontal which is less than the predetermined angle.

12. A lifting mechanism as claimed in claim 11 in which the biasing means are associated with means for permitting adjustment of at least the lifting torque applied to the toilet seat.

13. A lifting mechanism as claimed in claim 1 in which:

the support member has a hollow interior;

the spacing adjustment means comprise an extension attached to the lower bracket and extending upwardly into the interior of the support member, a first set of vertically spaced-apart teeth formed on the extension, a second set of vertically spaced-apart teeth formed on an interior wall of the support member, and means for releasably maintaining the first and second sets of teeth in meshed relationship with the sets of teeth vertically offset according to different selectable amounts.

14. A lifting mechanism as claimed in claim 1 in which the means for forming the floating connection comprise a slide formed on the arm and a member attachable to the toilet seat and having a longitudinal channel which retains and guides movement of the slide.

15. A foot-actuated lifting mechanism for a toilet seat, comprising:

an elongate support structre having an upper end portion and a lower end portion;

an upper bracket attached to and extending transversely from the upper end portion of the support structure;

a lower bracket attached to and extending transversely from the lower end portion of the support structure;

spacing adjustment means for permitting selective adjustment of the vertical spacing between the upper and lower brackets;

means for securing the upper bracket to the toilet;

means for securing the lower bracket to the toilet;

an arm adjacent to the upper end portion of the support structure;

means for connecting the arm to the toilet seat such that the toilet seat pivots upwardly and downwardly with corresponding upward and downward pivoting of the arm;

a free-standing foot pedal, the foot pedal having a first end portion, a second opposing end portion, and a fulcrum intermediate the first and second foot pedal end portions such that, with the fulcrum rested on a floor surrounding the toilet, depression of the second foot pedal end portion raises the first foot pedal end portion;

linkage means attached to and supported by the support structure for coupling the foot pedal to the arm such that the said raising of the first foot pedal end portion pivots the arm upwardly thereby to raise the toilet seat.

16. A lifting mechanism as claimed in claim 15 in which the linkage means include a lower linkage portion attached to the first foot pedal end portion and means associated with the lower linkage portion for permitting vertical extension and retraction of the lower linkage portion.

17. A lifting mechanism as claim 15 in which:

the spacing adjustment means permit the vertical position of the lower bracket relative to the support structure to be adjusted;

the linkage means comprise means for permitting vertical extension and retraction of a lower end portion of the linkage means such that the fulcrum of the foot pedal can be rested on the floor with changes in the vertical position of the lower bracket.

18. A lifting mechanism as claimed in claim 17 in which:

the linkage means comprise a vertically-oriented rod;

the means for permitting extension and retraction comprise a member in threaded engagement with the rod and connected to the foot pedal, the member being rotatable relative to the rod to increase and decrease the vertical separation of the foot pedal and the rod.

19. A lifting mechanism as claimed in claim 15 in which the linkage means comprise:

a shaft rotatable about its longitudinal axis, the arm extending transversely from the shaft;

an axial drive member;

means attaching the axial drive member to the support structure such that axial displacement of the member causes rotation of the rotatable shaft;

means for connecting the axial drive member to the first foot pedal end portion such that such the said raising of the first foot pedal end portion causes upward axial displacement of the axial drive member.

20. A lifting mechanism as claimed in claim 19 comprising means for permitting vertical extension and contraction of the axial drive member such that the fulcrum of the foot pedal can be rested on the floor with changes in the vertical separation of the upper and lower brackets.

21. A lifting mechanism as claimed in claim 20 in which the linkage means comprises biasing means for applying a lowering torque to the toilet seat when the toilet seat forms an angle relative to horizontal which is greater than a predetermined angle and for applying a lifting torque to the toilet seat when the toilet seat forms an angle relative to horizontal which is less than the predetermined angle.

22. A lifting mechanism as claimed in claim 21 in which the biasing means comprise:

a torsion spring mounted on the rotatable shaft, the torsion spring producing a lowering torque at the toilet seat;

a compression spring connected to the axial drive member, the compression spring producing a lifting torque at the toilet seat.

23. A lifting mechanism as claimed in claim 22 in which:

the compression spring is coaxially aligned with the axial drive member;

the support structure defines a lower stop for engaging a lower end portion of the compression spring;

the axial drive member is associated with an upper stop for engaging an upper end portion of the compression spring;

the upper stop is threaded onto the axial drive member such that the vertical spacing between the upper and lower stops can be adjusted by rotating the upper stop about the axial drive member thereby adjusting the lifting torque produced by the compression spring at the toilet seat.

24. A lifting mechanism as claimed in claim 15 comprising biasing means for applying a lowering torque to the toilet seat when the toilet seat forms an angle relative to horizontal which is greater than a predetermined angle and for applying a lifting torque to the toilet seat forms an angle relative to horizontal which is less than the predetermined angle.

25. A lifting mechanism as claimed in claim 24 in which the biasing means are associated with means for permitting adjustment of at least the lifting torque applied to the toilet seat.

26. A lifting mechanism as claimed in claim 15 in which:

the support member has a hollow interior;

the spacing adjustment means comprise an extension attached to the lower bracket and extending vertically into the interior of the support member, the lower bracket being movable vertically relative to the support member, and means for releasably securing the extension to the support member at selectable vertical positions relative to the support member.

27. A lifting mechanism as claimed in claim 26 in which the means for releasably securing the extension to the support member comprise a first set of vertically spaced-apart teeth formed on the extension, a second set of vertically spaced-apart teeth formed in an interior wall of the support member, and means for releasably maintaining the first and second sets of teeth in meshed relationship with the sets of teeth vertically offset according to different selectable amount.

28. A foot-actuated lifting mechanism for a toilet seat, comprising:

an elongate housing having an upper end portion, a lower end portion and a hollow interior;

an upper bracket attached to and extending transversely from the upper end portion of the housing and adapted to cooperate with a seat bolt to secure the upper end portion of the support structure to the toilet;

a lower bracket attached to and extending transversely from the lower end portion of the housing and adapted to cooperate with a base bolt to secure the lower end portion of the support structure to the toilet;

spacing adjustment means attached to the housing for permitting selective adjustment of the vertical spacing between the upper and lower brackets;

an arm adjacent to the upper end portion of the housing and disposed with respect to the brackets such that the arm locates beneath the toilet seat as the housing is secured to the toilet by the upper and lower brackets;

a foot pedal;

linkage means mounted in the interior of the housing for connecting the foot pedal to the arm such that pivoting of the foot pedal displaces the arm upwardly against the toilet seat thereby to raise the toilet seat.

* * * * *